US006612223B2

(12) United States Patent
Leonard et al.

(10) Patent No.: US 6,612,223 B2
(45) Date of Patent: Sep. 2, 2003

(54) PNEUMATIC ACTUATOR

(75) Inventors: Joshua R. Leonard, Noblesville, IN (US); Robert F. Elliott, Westfield, IN (US)

(73) Assignee: BFS Diversified Products, LLC, Carmel, IN (US)

( * ) Notice: Subject to any disclaimer, the term of this patent is extended or adjusted under 35 U.S.C. 154(b) by 8 days.

(21) Appl. No.: 10/066,438

(22) Filed: Jan. 31, 2002

(65) Prior Publication Data

US 2003/0140783 A1 Jul. 31, 2003

(51) Int. Cl.[7] ..... F01B 19/00; B66F 3/24
(52) U.S. Cl. ..... 92/96; 254/93 HP
(58) Field of Search ..... 92/98 R, 96, 35, 92/34; 254/93 HP

(56) References Cited

U.S. PATENT DOCUMENTS

| | | | | |
|---|---|---|---|---|
| 2,070,960 A | * | 2/1937 | Phillips | 254/93 HP |
| 2,698,887 A | | 1/1955 | Shaw | |
| 3,799,504 A | * | 3/1974 | Vaughen | 254/93 HP |
| 3,822,861 A | | 7/1974 | Scott | |
| 3,982,731 A | | 9/1976 | Tezuka | |
| 4,467,484 A | | 8/1984 | Nagatake et al. | |
| 4,733,603 A | | 3/1988 | Kukolj | |
| 4,751,869 A | | 6/1988 | Paynter | |
| 4,754,107 A | | 6/1988 | Tracey | |
| 4,773,519 A | | 9/1988 | Candle et al. | |
| 4,819,547 A | | 4/1989 | Kukolj | |
| 4,850,955 A | | 7/1989 | Newkirk | |
| 4,948,107 A | | 8/1990 | Orndorff, Jr. | |
| 5,067,390 A | | 11/1991 | Negishi | |
| 5,155,309 A | | 10/1992 | Dwyer | |
| 5,178,367 A | * | 1/1993 | Vaughen | 254/93 HP |
| 5,461,207 A | | 10/1995 | Van Lear | |
| 5,506,012 A | | 4/1996 | Wright et al. | |
| 5,881,917 A | | 3/1999 | Jones et al. | |
| 5,938,179 A | | 8/1999 | Beukers et al. | |
| 5,962,826 A | | 10/1999 | Bassin | |
| 5,979,864 A | | 11/1999 | Eggleston | |
| 6,121,559 A | | 9/2000 | Bassin | |

FOREIGN PATENT DOCUMENTS

| | | |
|---|---|---|
| DE | 1 299 432 | 11/1968 |
| DE | 24 05 788 A1 | 8/1975 |
| DE | 1 129 210 | 10/1995 |
| EP | 0 626 338 A1 | 11/1994 |

* cited by examiner

*Primary Examiner*—Edward K. Look
*Assistant Examiner*—Thomas E. Lazo
(74) *Attorney, Agent, or Firm*—Michael R. Huber; Michael Sand

(57) ABSTRACT

A pneumatic actuator adapted for placement between a pair of spaced members for controlling relative movement between said members is formed of two different hardness plastic materials and includes a rigid base and a flexible top member forming an internal air chamber therebetween. The top member is movable between collapsed and expanded positions by pressurized air introduced into the internal chamber for relative movement of the spaced members. The base has a sidewall terminating in a peripheral edge on which the top member is sealingly secured by a hot welded joint. A central portion of the top member has a raised thickened portion which engages one of the spaced members. A stop is located within the internal chamber to maintain the central portion of the top member above the peripheral edge of the base to prevent contact of the spaced member with the sealed joint when the top member is in the collapsed position. An air passage is formed in the base to enable the pressurized air to enter the internal chamber.

22 Claims, 3 Drawing Sheets

PNEUMATIC ACTUATOR

BACKGROUND OF THE INVENTION

1. Technical Field

The invention relates to pneumatic actuators and particularly to a two-piece actuator formed of two plastic members of different hardnesses which are welded together by a heated joint. More particularly, the invention relates to a pneumatic actuator which is expanded outwardly into engagement with a work-piece by introducing pressurized air into an interior chamber of the actuator.

2. Background Information

Pneumatic actuators and/or air springs are well known in the art and usually comprise an elastomeric or resilient sleeve or bellows which is mounted between a pair of spaced members for maintaining the members in the predetermined spacing, and/or for moving one of the members with respect to the other by applying a force as a function of the spacing and internal pressure, or for absorbing shock exerted on one or both of the members. Pneumatic actuators move one of a pair of spaced members by introducing a pressurized fluid, usually air, within a hollow cavity formed within the pneumatic actuator. These actuators have various configurations and are formed of various materials.

Other actuators include a flexible member which when depressed, forces air from within a hollow interior through a fluid line to a remote device which actuates a switch to perform a various function. Examples of such pneumatic control actuation or switches are shown in U.S. Pat. Nos. 4,754,107, 5,155,309, 5,461,207, 5881,917, 5,962,826, and 6,121,559. None of these actuators use the flexible top member for expanding outwardly to move a workpiece or perform a similar function, but are depressed to provide a signal or switching function.

One problem that exists with many of the known air actuators is that excess movement of the flexible top member towards a more rigid base can cause damage to the top member and especially to a sealed joint formed between the top member and the base which is required to form an airtight internal chamber.

These prior air actuators are generally assembled from three or more components which must be manufactured, inventoried, and subsequently assembled, all of which increase the cost of the final product.

Although these prior art actuators which are used for initiating and sending a signal may be satisfactory for their intended purpose, it is desirable to form a more inexpensive, lightweight, extremely durable pneumatic actuator having a low profile formed of only two pieces of molded plastic, one of which has a greater hardness than the other in order to provide movement to a workpiece engaged by the actuator.

BRIEF SUMMARY OF THE INVENTION

The invention provides a pneumatic actuator preferably formed of only two members, each of which is formed of a plastic material such as polyurethane, with a rigid base and a flexible top member secured thereto by a hot seam welded joint.

Another feature of the invention is to provide the actuator with a stop located within the internal air chamber which extends either upwardly from the base or downwardly from the flexible top member to limit the movement of the flexible top member toward a collapsed position to prevent the workpiece from contacting and possibly damaging the welded joint between the flexible top member and rigid base.

Another aspect of the pneumatic actuator is to provide the flexible top member with an annular convolution which surrounds a work engaging central portion of the top member to provide increased flexibility to the top member and to assist it to return to an at-rest position. The profile of the annular convolution is also designed to reduce fatigue on the material and welded joint and increase the life thereof, and in which the convolution can be designed to regulate the effective area within the air chamber and thus the work characteristics achieved by the flexible top member.

A further feature of the invention is providing the flexible top member with a thickened central work engaging portion surrounded by one or more convolutions providing increased stiffness to the flexible top member without materially affecting the flexibility thereof.

The pneumatic actuator preferably has a hot welded joint joining the flexible top member to the base which extends along an upper peripheral edge of the base to enable the base and top member to be easily joined together with a relatively simple welding procedure.

A further feature of the invention is providing the base with an opening having either a barbed coupler molded therein for connecting to an air supply line, or having an opening adapted to receive a barbed metal coupler or an air supply line molded therein.

Another aspect of the invention is that the flexible top member will have a durometer within the range of 80–90 Shore A hardness and that the polyurethane base will have a durometer in the range of 50–80 Shore D hardness; and in which the actuator can easily operate with pressures around 30 psi and withstand greater pressures of approximately 50 psi.

Another feature of the invention is providing the base with mounting flanges integral with the base for receiving fasteners through formed openings therein for easily mounting the rigid base to a supporting structure.

A further feature of the invention is providing the base and top members with various configurations such as oval, circular, oblong, etc.

The foregoing advantages, construction and operation of the present invention will become readily apparent from the following description and accompanying drawings.

BRIEF DESCRIPTION OF THE DRAWINGS

Similar numerals refer to similar parts throughout the drawings.

DETAILED DESCRIPTION OF THE INVENTION

Figure 1:
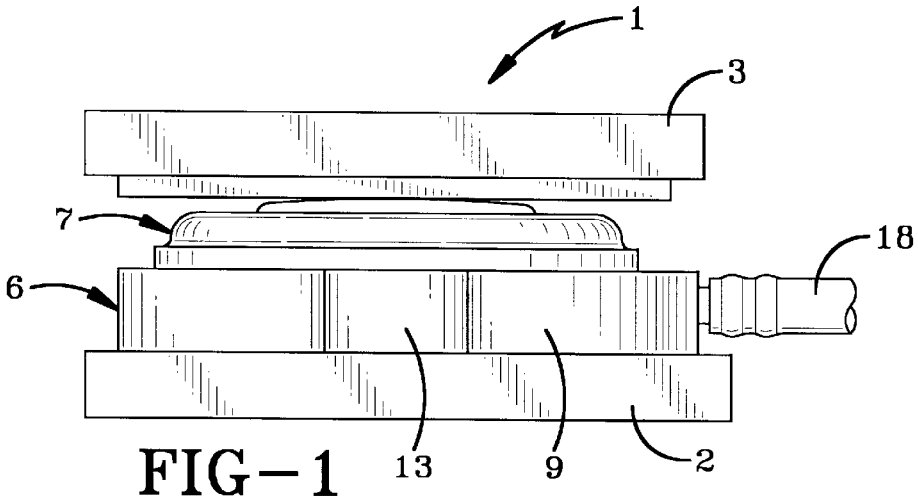
FIG. 1 is a side elevational view showing the improved pneumatic actuator mounted between a pair of spaced work members.

The pneumatic actuator of the present invention is indicated generally at 1, and is shown in FIG. 1 mounted between a pair of spaced workpieces 2 and 3 for moving one of the workpieces with respect to the other upon actuation of actuator 1. One type of installation in which actuator 1 can be utilized is in a conveyor application wherein movable workpiece 3 is the brake or release mechanism for the conveyor. Thus, to start or stop the conveyor, pneumatic air is supplied to or removed from the actuator which will move workpiece 3 with respect to workpiece 2. However, actuator 1 can be used for numerous types of applications requiring movement of one spaced member or workpiece with respect to the other member.

Figure 2:
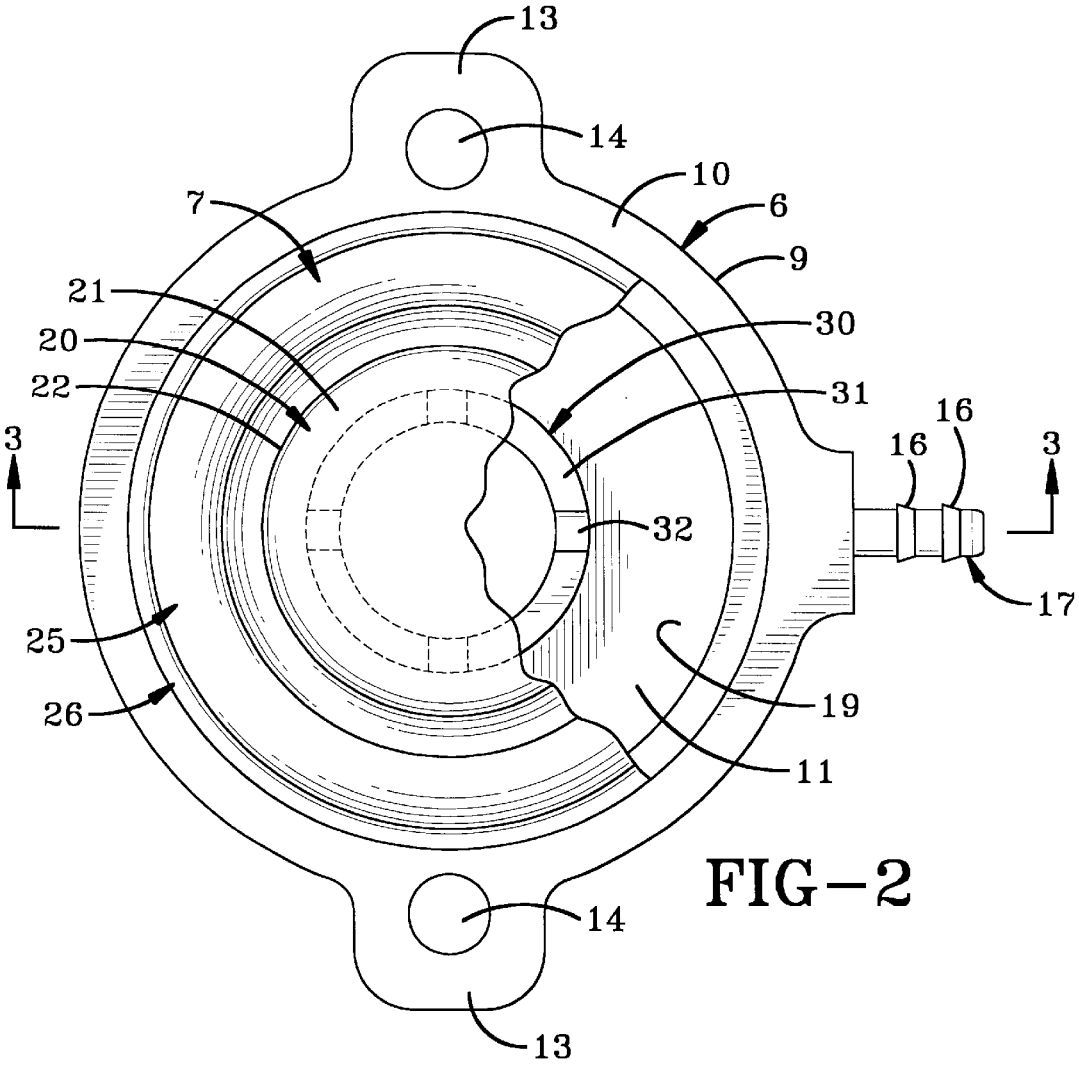
FIG. 2 is a top plan view of the pneumatic actuator with portions broken away.
Figure 3:
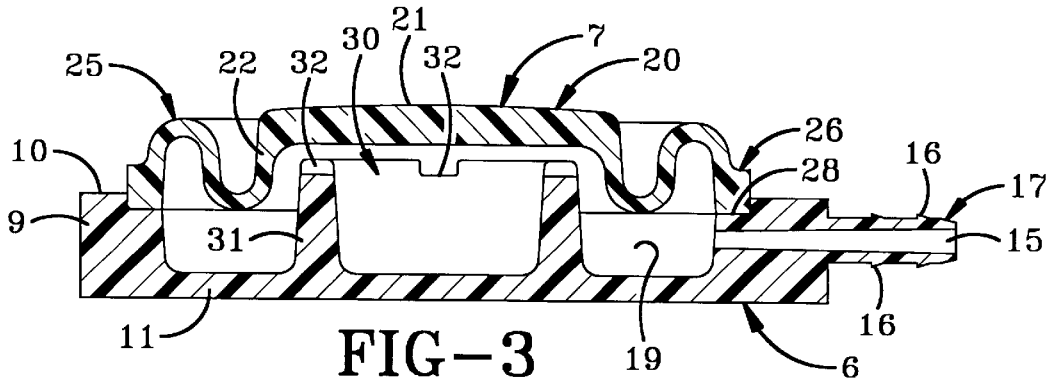
FIG. 3 is a sectional view taken on line 3—3, FIG. 2.
Figure 5:
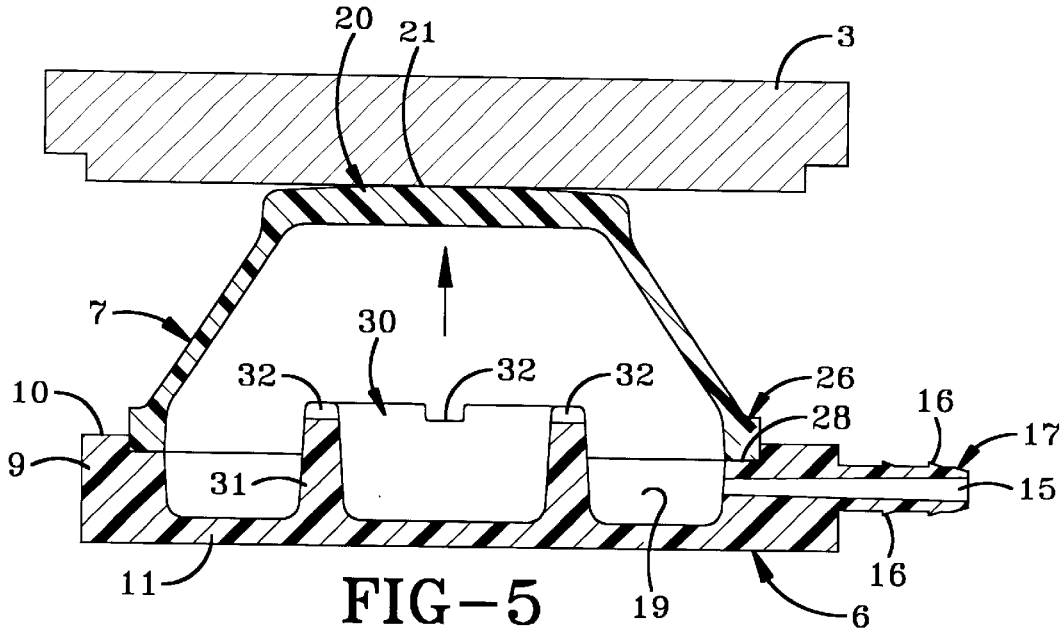
FIG. 5 is a sectional view showing the flexible top member in an expanded position moving the upper work member away from the lower work member.

Actuator 1 includes a rigid base 6 formed of a plastic material and a flexible top member 7 also formed of plastic material having a lower durometer rating then that of base 6 and being flexible so as to expand outwardly from an at rest position as shown in FIG. 3, to an expanded position as shown in FIG. 5. Base 6 includes an annular sidewall 9 which terminates in an annular peripheral top edge 10 and a bottom wall 11. A pair of mounting flanges 13 (FIG. 2) are formed integrally with bottom wall 11 and extend outwardly at opposition locations from wall 11. Holes 14 may be formed in flanges 13 to receive a fastener such as a bolt, nail, screw, etc. for securing actuator 1 to workpiece 2.

A hose coupler 17 preferably is formed integrally with base 6, and extends outwardly therefrom having a central opening or bore 15 and a plurality of barbs 16 for securing a fluid supply tube 18 thereon. Tube 18 is adapted to be connected to a remote source of pressurized fluid (not shown) which usually will be air, although other types of fluids could be utilized without affecting the concept of the invention. Coupler 17 and its opening 15, provides fluid communication with an internal chamber 19 formed between base 6 and top member 7 for supplying or removing air therefrom. In the preferred embodiment, base 6 will have a durometer generally within the range of 50–80 Shore D hardness with the preferred range being 60–70 Shore D. Top member 7 will have a hardness in the range of 80–90 Shore A with a preferred range being 85–88 Shore A. Shore A and Shore D hardness scales are common, with the A scale being used for softer material such as top member 7, and the D scale being used for harder material such as base 6.

Top member 7 is formed with a generally annular shaped work engaging area indicated generally at 20, having a generally circular work engaging top surface 21 defined by a cylindrical sidewall 22. In accordance with one of the features of the invention, one or more convolutions 25 extend between work engaging area 20 and an outer annular peripheral area 26 of top member 7. Convolutions 25 provide for increased flexibility to top member 7 enabling it to expand outwardly as shown in FIG. 5 and assists to returning it to its normal at-rest position as shown in FIG. 3. It also can have a thinner wall area than that of work engaging area 20 to increase the flexibility of top member 7 while providing a thickened work area 20, thereby increasing the life of the actuator. Also, the size and configuration of convolution 25 will effect the load and characteristics of the actuator providing increased versatility thereto.

In accordance with another feature of the invention, outer annular area 26 of top member 7 is secured to peripheral edge 10 of base sidewall 9 by a heat welded joint 28. This heat welded joint may be formed by hot plate welding, friction welding, or the like but could be replaced by an adhesive bond, although the heat welded joint is preferred, since it provides for a rigid bonding between the two plastic materials. Also in the preferred embodiment, the plastic material will be a polyurethane although other types of plastics could be utilized.

Figure 4:
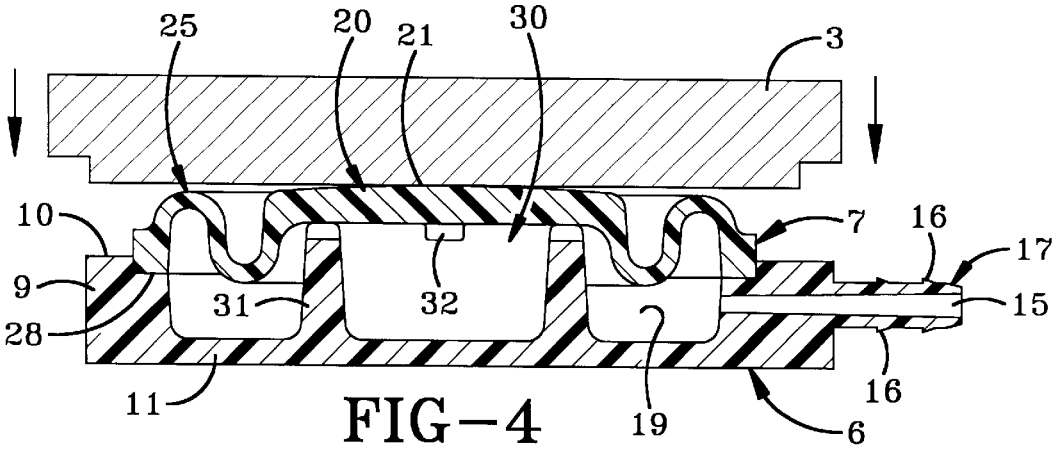
FIG. 4 is a sectional view similar to FIG. 3 showing the upper work member moving the flexible top member to a collapsed position.

Another feature of the invention is the providing of a stop indicated generally at 30, within air chamber 19. A first embodiment of stop 30 is shown in FIGS. 3–5 wherein an annular projection or wall 31 is formed integrally with bottom wall 11 of base 6 and extends upwardly therefrom and is aligned with cylindrical sidewall 22 of work engaging area 20. A plurality of grooves or openings 32 are formed in stop wall 31 to prevent the top member from sealing too tightly thereagainst when in a fully collapsed position as shown in FIG. 4 which would decrease the amount of area the pressurized fluid could work on.

Figure 6:
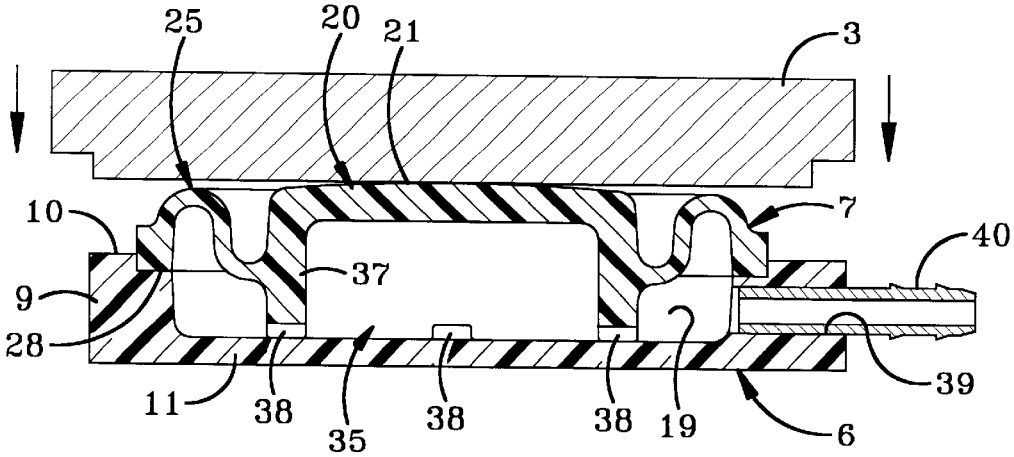
FIG. 6 is a sectional view showing a modified pneumatic actuator in a collapsed position.

A modified stop 35 is shown in FIG. 6 in which an annular sidewall 37 of work engaging area 20 extends downwardly therefrom a considerable distance into air chamber 19 so as to engage base bottom wall 11 when in the collapsed position. Again, a plurality of holes or grooves 38 are formed in extended sidewall 37 to prevent the sidewall from sealing tightly against base wall 11 when in the collapsed position.

In accordance with still another feature of the invention, work engaging surface 21 will be above welded joint 28 when in the collapsed position as shown in FIGS. 4 and 6 to prevent workpiece 3 from pressing against the welded joint, possibly reducing the effectiveness of its seal with base 6. Thus, when in the collapsed position, stops 30 and 35 will absorb the force and prevent workpiece 3 from crushing or applying excess pressure to the welded joint or to the peripheral edge of base sidewall 9.

Base 6, as shown in FIG. 6, could be molded with an opening 39 in sidewall 9 which a metal barbed or cartridge type coupler 40 is inserted and secured as a modification to the integral molding of coupler 17 with sidewall 9 as shown in the embodiment of FIGS. 3–5.

Thus, pneumatic actuator 1 is a relatively simple, inexpensive device consisting of only two plastic members formed of different hardnesses having a rigid base and a generally dome-shaped flexible top member which are secured together by a heat welded joint, which has annular convolutions formed in the top member to provide various operating characteristics to the actuator by changing the effective area within the air chamber, and in which stops are provided within the air chamber to prevent damage to the heat welded joint.

Although the base and top member are shown as being substantially circular it is readily understood that they can have other shapes without effecting the concept of the invention such as oval, oblong, etc.

While embodiments of the invention have been described, the invention is not limited thereto, but can have other modifications and arrangements without affecting the concept of the invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. An actuator comprising:

a base formed of a rigid plastic material having a bottom wall and an upstanding sidewall terminating in a peripheral edge;

a flexible top member mounted on the peripheral edge of the base and forming an internal chamber with said base, said top member being formed of a plastic material having greater flexibility than the base member and having a central work engaging surface;

a welded joint sealingly connecting the top member to the peripheral edge of the base; and an opening formed in the base for supplying the internal chamber with a pressurized fluid to move the top member from a retracted position to an expanded position.

2. The actuator defined in claim 1 in which the base and top member are formed of polyurethane with the top member having a durometer generally in the range of 80–90 Shore A and the base having a durometer generally in the range of 50–80 Shore D.

3. The actuator defined in claim 2 in which the top member has a hardness in the range of 85–88 Shore A and the base has a hardness in the range of 60–70 Shore D.

4. The actuator defined in claim 1 in which a coupler is mounted in the opening of the base for connection to a fluid supply line.

5. The actuator defined in claim 1 in which an annular convolution is formed in the top member and extends concentrically about the work engaging surface.

6. The actuator defined in claim 5 in which the work engaging surface is a top wall of a dome-shaped member having a sidewall which emerges into the convolution.

7. The actuator defined in claim 6 in which the sidewall of the dome-shaped member extends into the internal chamber and engages the bottom wall of the base when the top wall is in a collapsed position to form a stop to maintain the work engaging surface of the top member above the peripheral edge of the base when the top member is in the collapsed position.

8. The actuator defined in claim 1 in which a stop located within the internal chamber to maintain the work engaging surface of the top member above the peripheral edge of the base when the top member is in a collapsed position.

9. The actuator defined in claim 8 in which the stop includes a projection formed on the bottom wall of the base which projects into the internal chamber and engages a sidewall of a dome-shaped member which forms the work engaging surface when the top member is in the collapsed position.

10. The actuator defined in claim 8 in which the stop is formed with an opening to provide an air passage within the internal chamber to prevent sealing of the top member against the stop when said top member is in the collapsed position.

11. The actuator defined in claim 8 in which the stop includes an annular projection extending from the bottom wall of the base; and in which said annular projection terminates above a plane defined by the peripheral edge of the base member sidewall.

12. An air actuator comprising:

a one-piece base having a bottom wall and a sidewall forming an internal chamber;

an opening formed in the base for connecting the internal chamber to a supply of pressurized air;

a flexible top member mounted on the base and movable from a retracted position to an expanded position by pressurized air;

a joint sealingly connecting the base to the flexible top member;

the top member having an outer work engaging surface and an annular convolution surrounding the work engaging surface; and a stop located within the internal chamber maintaining the outer work engaging surface above the sealing joint when the top member moves towards the base.

13. The air actuator defined in claim 12 in which the base and top members are formed of a polyurethane material; and in which the top member has a durometer less than the durometer of the base.

14. The air actuator defined in claim 12 in which the base sidewall terminates in a peripheral edge; and in which the sealing joint is formed along said peripheral edge.

15. The air actuator defined in claim 12 in which the work engaging surface is an outer surface of a dome-shaped member which includes an annular sidewall which merges into the convolution.

16. The air actuator defined in claim 15 in which the stop includes a projection extending from the bottom wall of the base into the internal chamber and engages the annular sidewall of the dome-shaped member when the top member is in a collapsed position.

17. The air actuator defined in claim 16 in which the projection includes an annular wall complementary in diameter to a diameter of the annular sidewall of the dome-shaped member.

18. The air actuator defined in claim 17 in which at least one opening is formed in one of the annular walls of the dome-shaped member and the annular wall of the projection to prevent sealing of the flexible top member to said projection.

19. The air actuator defined in claim 15 in which the annular sidewall of the dome-shaped member extends into the internal cavity beyond the convolution and forms the stop member.

20. The actuator defined in claim 12 in which the durometer of the top member is in the range of 80–90 Shore A; and in which the durometer of the base is in the range of 50–80 Shore D.

21. The air actuator defined in claim 12 in which an air supply line coupler is mounted in the opening of the base.

22. The air actuator defined in claim 21 in which the coupler is formed of metal.

* * * * *